US007394032B2

(12) United States Patent
Händler et al.

(10) Patent No.: US 7,394,032 B2
(45) Date of Patent: Jul. 1, 2008

(54) ELECTRODYNAMICALLY TILTING CONTACT SYSTEM FOR POWER CIRCUIT BREAKERS

(75) Inventors: Kurt Händler, Bonn (DE); Wolfgang Kremers, Bonn (DE); Heinz Pursch, Berlin (DE); Hartwig Stammberger, Alfter (DE); Albert Zacharias, Neuwied (DE)

(73) Assignee: Moeller GmbH, Bonn (DE)

( * ) Notice: Subject to any disclaimer, the term of this patent is extended or adjusted under 35 U.S.C. 154(b) by 0 days.

(21) Appl. No.: 10/596,585

(22) PCT Filed: Dec. 9, 2004

(86) PCT No.: PCT/EP2004/053361

§ 371 (c)(1),
(2), (4) Date: Jun. 22, 2007

(87) PCT Pub. No.: WO2005/059941

PCT Pub. Date: Jun. 30, 2005

(65) Prior Publication Data

US 2007/0251809 A1 Nov. 1, 2007

(30) Foreign Application Priority Data

Dec. 16, 2003 (DE) ..... 103 58 828

(51) Int. Cl.
*H01H 1/22* (2006.01)

(52) U.S. Cl. ..... 200/244; 200/400

(58) Field of Classification Search ..... 200/244, 200/248, 287, 11 R, 400, 401, 17 R
See application file for complete search history.

(56) References Cited

U.S. PATENT DOCUMENTS 4,910,485 A 3/1990 Bolongeat-Mobleu et al.
6,259,048 B1 7/2001 Castonguay et al.

(Continued)

FOREIGN PATENT DOCUMENTS

DE 42 22 965 C1 11/1993
DE 100 56 820 A1 5/2002

*Primary Examiner*—Michael A. Friedhofer
*Assistant Examiner*—Lisa N Klaus
(74) *Attorney, Agent, or Firm*—Darby & Darby

(57) ABSTRACT

An electrodynamically tilting contact system for power circuit breakers includes an actuating shaft segment, a rotary contact bridge pivotally mounted therein and contact force springs that form components of a tilting snap-action mechanism, which holds the rotary contact bridge in a repulsed position after an electrodynamically effected repulsion of fixed contacts. Two rockers, while serving as an additional component of the tilting snap-action mechanism, are mounted on the rotary contact bridge in a manner that enables them to tilt. The contact force springs are supported between the actuating shaft segment and the rockers, whereby the spring longitudinal axes, the tilting axes of the rockers, and the rotational symmetry axis of the rotary contact bridge are located in the tilting point plane of the tilting snap-action mechanism. The rotary contact bridge is mounted in the actuating shaft segment via a bearing pin and an elongated hole bearing whose longitudinal axis, together with the tilting point plane, forms an, at most, acute angle perpendicular to the bearing pin.

8 Claims, 3 Drawing Sheets

U.S. PATENT DOCUMENTS 6,403,901 B1 * 6/2002 Boeder et al. ..... 200/244
6,870,112 B2 * 3/2005 Bresciani et al. ..... 200/244
7,005,594 B2 * 2/2006 Kim ..... 200/244
7,189,935 B1 * 3/2007 Hassan et al. ..... 200/244
7,221,246 B2 * 5/2007 Rajauria et al. ..... 335/16
7,297,021 B1 * 11/2007 Dixon et al. ..... 439/517

* cited by examiner

ELECTRODYNAMICALLY TILTING CONTACT SYSTEM FOR POWER CIRCUIT BREAKERS

The invention relates to an electrodynamically tilting contact system for power circuit breakers, especially for current-limiting circuit breakers, in which a breaker shaft segment, a rotary contact bridge pivotably mounted therein and contact force springs constitute components of a tilting snap-action mechanism that holds the rotary contact bridge in a repulsed position after the fixed contacts have been electrodynamically repulsed.

BACKGROUND

German patent application DE 100 56 820 A1 discloses a contact system for each pole of a power circuit breaker having a rotary contact bridge that electrically connects or disconnects two fixed contacts that are positioned across from each other. The rotary contact bridge is float-mounted in a breaker shaft segment by means of two contact force springs configured as pressure springs. The contact force springs are mounted across from each other on both sides of the rotary contact bridge in bores made in the breaker shaft and, through their free spring ends fitted with sliding elements, are constantly interacting with control cams of the rotary contact bridge. When the control cams are appropriately configured, the rotary contact bridge, the contact force springs and the breaker shaft segment form a tilting snap-action mechanism. When the rotary contact bridge is electrodynamically repulsed from the fixed contacts due to a short-circuit current flowing through the contact system, the free spring ends slide along the control cams with increasing compression of the contact force springs until, after passing the tilting point of the tilting snap-action mechanism, they move into latching depressions of the control cams. As a result, the rotary contact bridge remains in the repulsed position until it is deliberately moved away from this position by means of an actuating mechanism. A drawback of this is the unsatisfactory reproducibility of the dynamic tilting behavior of the contact system due to the frictional work that occurs between the pins and the control cams, due to the compressive forces on the free spring ends that are not directed towards the tilting axis and due to the tangential forces that act upon the sliding elements.

German patent specification DE 42 22 965 C1 discloses a contact system for each pole of a power circuit breaker having a single-arm contact lever that connects or disconnects a fixed contact and a connecting lead that is electrically connected to the contact lever in a tilting axis. The contact lever that is mounted along the tilting axis on a breaker shaft is impinged on both sides by a pair of contact force tension springs. These tension springs are suspended between the contact lever and the breaker shaft beyond the tilting axis in such a way that, together with the contact lever and the breaker shaft, they form a tilting snap-action mechanism. When the contact lever is electrodynamically repulsed from the fixed contact, the two connection straight lines run through the tilting axis of the tilting snap-action mechanism in the tilting point—also referred to as the dead center—and, at this moment, said straight lines forming the tilting point plane, which can also be called the dead center plane. Transferring such a tilting snap-action mechanism to a contact system with a rotary contact bridge would detrimentally result in an enlargement of the contact system because of the working volume needed for the tension springs.

SUMMARY OF THE INVENTION

An object of the present invention is to improve the reproducibility of the tilting behavior while avoiding the need for additional installation space.

The present invention provides a contact system for each pole of a power circuit breaker surrounded by a switching device housing, having fixed contacts across from each other, of a rotary contact bridge that electrically connects or disconnects the fixed contacts, of a breaker shaft segment in which the rotary contact bridge is pivotably mounted, and of contact force springs configured as pressure springs that engage between the breaker shaft segment and the rotary contact bridge,

- whereby the rotary contact bridge, the breaker shaft segment and the contact force springs constitute components of a tilting snap-action mechanism that holds the rotary contact bridge in a repulsed position after the fixed contacts have been electrodynamically repulsed,
- characterized in that
- as another component of the tilting snap-action mechanism, two rockers are mounted so as to tilt on the rotary contact bridge parallel to its rotation-symmetrical axis,
- the contact force springs are supported between the breaker shaft segment and the rockers,
- the spring longitudinal axes of the contact force springs, the tilting axes of the rockers and the rotation-symmetrical axis all lie in the tilting point plane of the tilting snap-action mechanism, and
- the rotary contact bridge is mounted in the breaker shaft segment by means of a bearing axis and a slot bearing whose longitudinal axis includes at the maximum an acute angle, with the tilting point plane perpendicular to the bearing axis.

The contact system according to the invention combines the advantages of a tilting snap-action mechanism—in which the connection straight lines run through the tilting axis of the tilting point system in the tilting point—with the advantages of using pressure springs. The tilting axis coincides with the bearing axis of the rotary contact bridge. No appreciable friction losses occur in the tilting snap-action mechanism made up of the rotary contact bridge, the contact pressure springs, the rockers and the breaker shaft segment. The transverse load of the contact force springs, which increases the tolerance, is largely avoided. This results in greater reproducibility of the tilting behavior of the contact system and thus in greater reliability for the planning of the installation that is to be protected with the power circuit breaker. In conjunction with the rockers, the contact force springs configured as pressure springs create a space-saving arrangement inside the breaker shaft segment. The bearing of the breaker shaft in a slot allows an uncomplicated compensation of the on-position of the rotary contact bridge in case of asymmetrical contact erosion of the contact surfaces associated with the rotary contact bridge or of the fixed contacts. The lengthwise extension of the slot bearing parallel to or at an acute angle relative to the tilting point plane of the tilting snap-action mechanism prevents de-stabilization of the contact system in the tilting point.

Holding the contact force springs on the contact bridge side in receiving bores of the rockers saves additional installation space, particularly so when the rocker webs provided with the receiving bores extend laterally beyond the rotary contact bridge. In an advantageous manner, the ends of the contact force springs that are far from the contact bridge are affixed by holding nubs and/or holding depressions formed in the breaker shaft segment.

The repulsion movement of the rotary contact bridge is advantageously limited by stops in the housing of the switching device.

The slot bearing is advantageously created in that the bearing axis of the rotary contact bridge is mounted in lateral slots of the breaker shaft segment. Advantageously, the slots run in the direction of the tilting point plane. Of course, conversely, the rotary contact bridge can also be provided with a slot through which the bearing axis that is defined in the breaker shaft segment runs.

BRIEF DESCRIPTION OF THE DRAWINGS

Additional details and advantages of the invention ensue from the embodiments below explained with reference to the figures. The following is shown.

DETAILED DESCRIPTION

Figure 1:
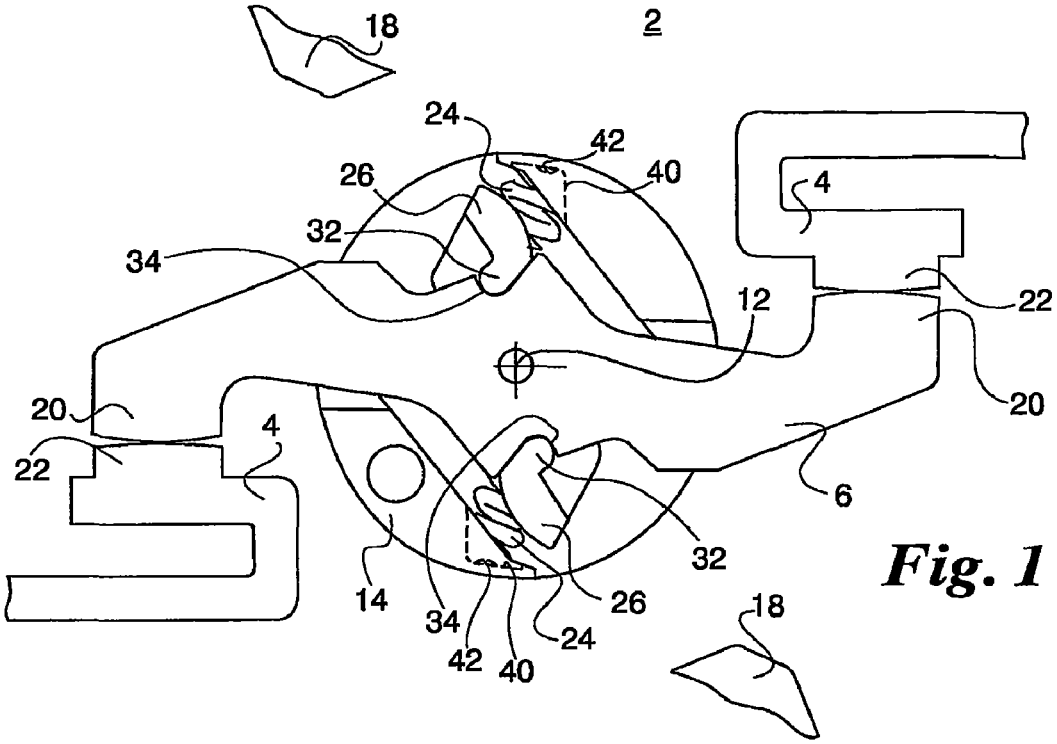
FIGS. 1, 3 and 5 show a longitudinal section of a contact system according to the invention, in the on-position, tilting point position and repulsed position.

The contact system 2 according to the invention shown for a pole of a multipolar power circuit breaker comprises two fixed contacts 4 across from each other and a rotary contact bridge 6. This rotary contact bridge 6 is pivotably mounted in its rotation-symmetrical axis 8 by means of a circular bearing bore 10 on a cylindrical bearing axis 12. The rotary contact bridge 6 protrudes on both sides out of a breaker shaft segment 14, whereby the bearing axis 12 lies with both of its ends in lateral slots 16 in the breaker shaft segment 14. The breaker shaft segment 14 is mounted with adjacent breaker shaft segments in a switching device housing 18 that is only indicated in a rudimentary form. The ends of the fixed contacts 4 and of the rotary contact bridge 6 have contact surfaces 20 and 22 respectively which, in the on-position according to FIG. 1, create a conductive connection between the two fixed contacts 4 under the effect of the force of two pairs of contact force springs 24. In a familiar manner, the contact system 2 is switched from the off-position into the on-position and vice-versa by means of an actuation mechanism, which is not shown here since it is not essential for the invention. When a short-circuit current flows through the contact system 2, repulsive electrodynamic forces occur that flip the rotary contact bridge 6 from the on-position shown in FIGS. 1 and 2 to the repulsed position shown in FIGS. 5 and 6. The loop-like configuration of the fixed contacts 4 contributes markedly to strengthening the electrodynamic repulsion forces.

Figure 2:
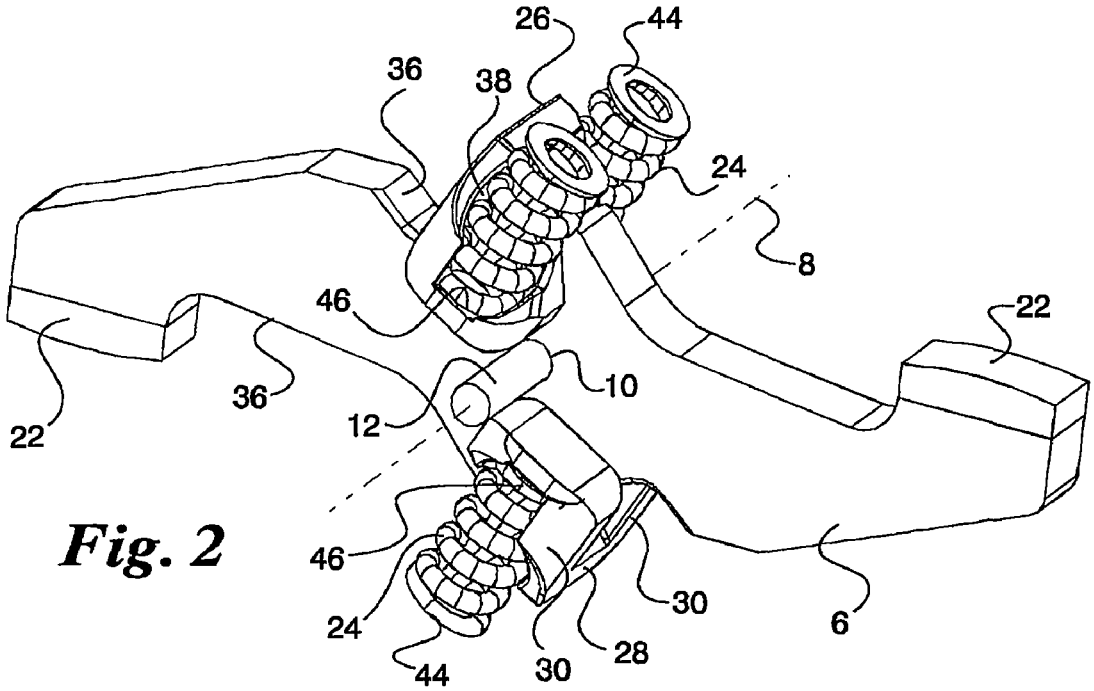
FIGS. 2, 4 and 6 show a perspective depiction of details of the contact system that are essential for the invention, in the on-position, tilting point position and repulsed position.
Figure 5:
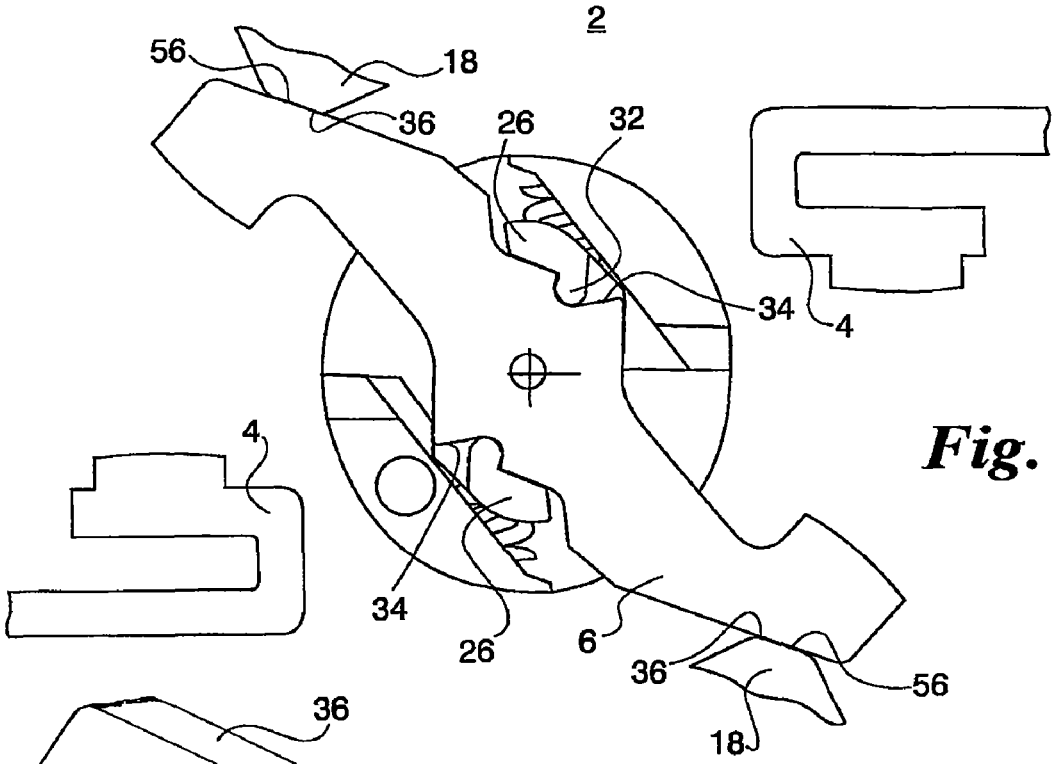
Figure 6:
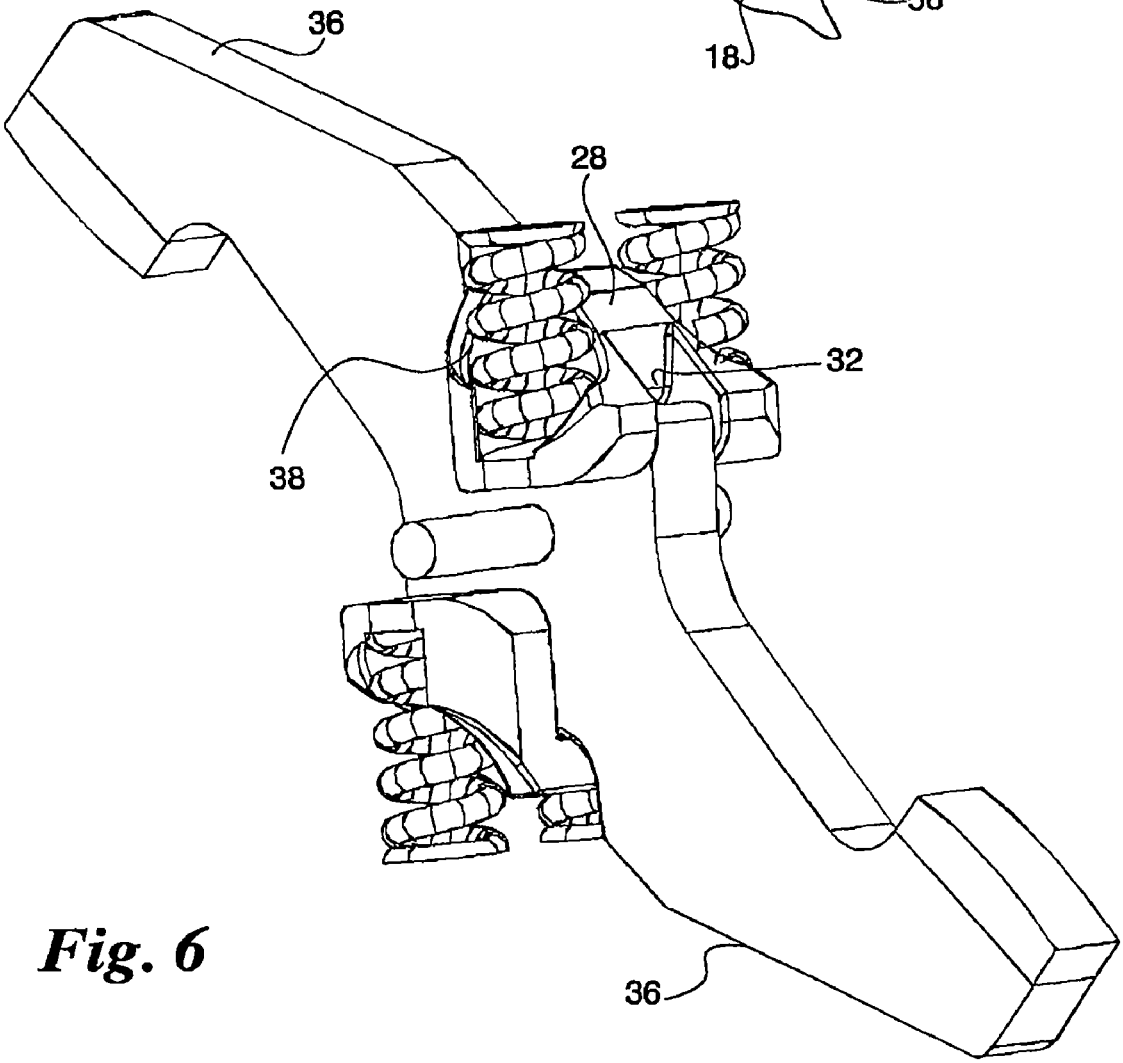

In order to prevent the rotary contact bridge 6 from returning of its own accord from the repulsed position according to FIGS. 5 and 6 to the on-position according to FIGS. 1 and 2, the contact system 2 is provided with a tilting snap-action mechanism that is configured rotation-symmetrically relative to the bearing axis 12. The tilting snap-action mechanism consists of the rotary contact bridge 6, the breaker shaft segment 14, the two pairs of contact pressure springs 24 and two rockers 26. These rockers 26 are mounted on the rotary contact bridge 6 across from its rotation-symmetrical axis 8. The rockers 26 are configured as U-shaped elements having a middle web 28 and two lateral rocker webs 30. Each middle web 28 is the starting point of a bearing leg 32. The rockers 26 are mounted with their bearing legs 32 so that they can be tilted in corresponding bearing mounts 34 that are formed in the front, narrow sides 36 of the rotary contact bridge 6. The rocker webs 30 protrude beyond the bearing legs 32 towards the rotation-symmetrical axis 8, so that the rockers 26 laterally engage with their rocker webs 30 over the rotary contact bridge 6.

Figure 3:
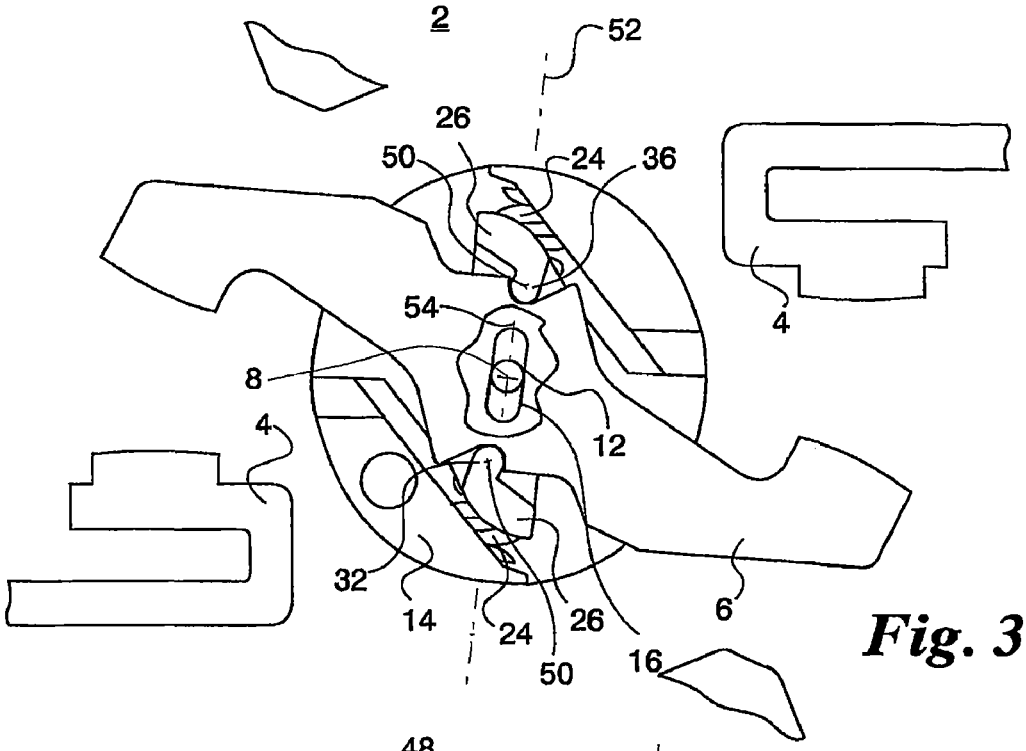
Figure 4:
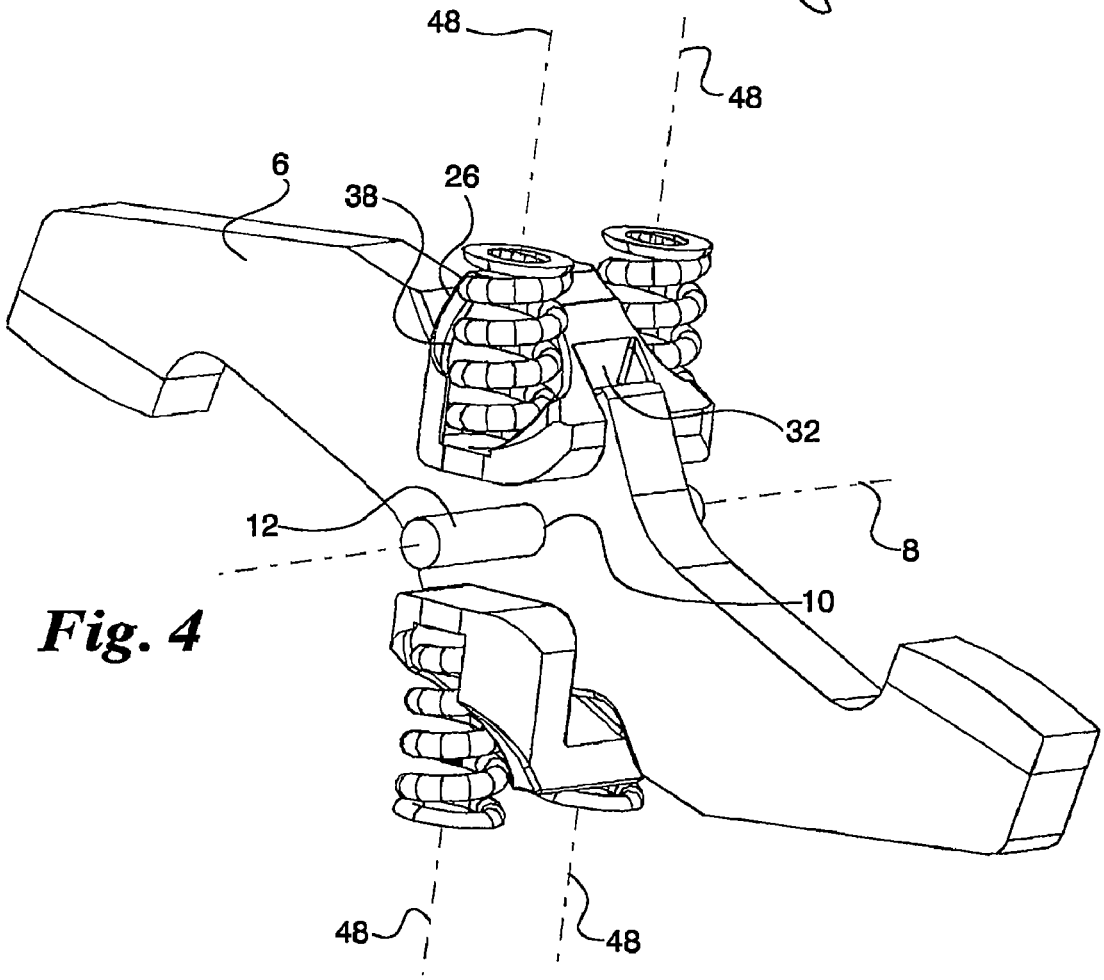

A receiving bore 38 is formed in each rocker web 30. Across from it, holding depressions 40 with holding nubs 42 facing the bearing axis 12 are formed in the breaker shaft segment 14. The contact force springs 24 are supported between the breaker shaft segment 14 and the rockers 26 in such a way that the spring ends 44 that are far from the contact bridge rest on the holding nubs 42 while the spring ends 46 close to the contact bridge are mounted in the receiving bores 38. With an eye towards achieving the objective of the invention, the tilting snap-action mechanism described above is arranged in a special manner in terms of the tilting point position shown in FIGS. 3 and 4, which is traversed during the course of the repulsion movement of the rotary contact bridge 6 from the on-position into the repulsed position. In the tilting point of the tilting snap-action mechanism, the spring longitudinal axes 48, the tilting axes 50 of the rockers 26 and the rotation-symmetrical axis 8 of the rotary contact bridge 6 coincide in the very same tilting point plane 52. The slot longitudinal axes 54 should only include a small angle, at the maximum an acute angle, with the tilting point plane 52. In the example, the slot longitudinal axes 54 ideally run in the tilting point plane 52. In order to limit the repulsion movement, stops 56 are formed in the switching device housing 18 that lie across from each other relative to the bearing axis 12 and against which the rotary contact bridge 6 strikes with its narrow side 36.

The present invention is not restricted to the embodiment described above. For instance, the invention can be modified to the effect that, in order to create the slot bearing in the rotary contact bridge 6, a slot is formed that runs along the rotation-symmetrical axis 8 through which the bearing axis 12 runs which, in turn, is mounted in circular bearing bores formed laterally in the breaker shaft segment 14.

The invention claimed is:

1. A contact system for a power circuit breaker, the contact system comprising:

a plurality of fixed contacts disposed across from each other;

a breaker shaft segment;

a rotary contact bridge pivotably mounted in the breaker shaft segment about a rotation symmetrical axis by means of a bearing axle and a slot bearing having a slot longitudinal axis perpendicular to the bearing axle, the rotary contact bridge configured to electrically connect and disconnect the fixed contacts;

two rockers mounted on the rotary contact bridge so as to tilt about a tilting axis with respect to the rotary contact bridge parallel to the rotation-symmetrical axis; and two contact force springs, each having a longitudinal axis and being supported between the breaker shaft segment and one of the rockers, wherein the rotary contact bridge, the breaker shaft segment, the contact force springs, and the rockers form a tilting snap-action mechanism for holding the rotary contact bridge in a repulsed position after the fixed contacts have been electrodynamically repulsed, and wherein the longitudinal axes of the springs, the tilting axes and the rotation-symmetrical axis lie in a tilting point plane of the tilting snap-action mechanism and the slot longitudinal axis forms at most an acute angle with the tilting point plane.

2. The contact system as recited in claim 1, wherein the contact force springs are pressure springs.

3. The contact system as recited in claim 1, wherein each rocker includes at least one receiving bore and wherein each contact force spring is mounted in one of the receiving bores with a first end of the contact force spring close to the contact bridge.

4. The contact system as recited in claim 3, wherein the rotary contact bridge includes a narrow side having two bearing mounts and wherein the rockers each include two receiving bores, a bearing leg disposed in one of the bearing mounts, and rocker webs on both sides of the bearing leg and protruding beyond the bearing leg towards the rotation-symmetrical axis, each rocker web having one of the two receiving bores.

5. The contact system as recited in claim 3, wherein the breaker shaft segment includes at least one of holding nubs and holding depressions, each configured to receive a second end of the contact force spring opposite the first end.

6. The contact system as recited in claim 1, wherein the switching device includes a housing and wherein stops are disposed across from each other in the housing and are configured to limit A repulsion movement of the rotary contact bridge.

7. The contact system as recited in claim 1, wherein the rotary contact bridge is mounted on the bearing axle with a circular-cylindrical bearing bore and wherein the bearing axle is mounted in lateral slots in the breaker shaft segment.

8. The contact system as recited in claim 1, wherein the slot longitudinal axis lies in the tilting point plane.

* * * * *